US008935828B2

(12) United States Patent
Ashbee et al.

(10) Patent No.: US 8,935,828 B2
(45) Date of Patent: Jan. 20, 2015

(54) DIRT SEPARATOR FOR A VACUUM CLEANER

(71) Applicant: Dyson Technology Limited, Wiltshire (GB)

(72) Inventors: Giles Ashbee, Swindon (GB); James Stuart Robertson, Bath (GB); Peter Luetchford, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/164,825

(22) Filed: Jan. 27, 2014

(65) Prior Publication Data

US 2014/0208539 A1 Jul. 31, 2014

(30) Foreign Application Priority Data

Jan. 31, 2013 (GB) ..... 1301711.6

(51) Int. Cl.

| | |
|---|---|
| ***A47L 9/10*** | (2006.01) |
| ***A47L 9/20*** | (2006.01) |
| ***A47L 9/16*** | (2006.01) |
| ***B04C 5/26*** | (2006.01) |
| ***B04C 5/28*** | (2006.01) |

(52) U.S. Cl.

CPC ..... *A47L 9/1625* (2013.01); *A47L 9/1633* (2013.01); *A47L 9/1641* (2013.01); *A47L 9/1666* (2013.01); *B04C 5/26* (2013.01); *B04C 5/28* (2013.01); *A47L 9/102* (2013.01)

USPC ..... 15/352; 15/353

(58) Field of Classification Search

None

See application file for complete search history.

(56) References Cited

FOREIGN PATENT DOCUMENTS

| | | |
|---|---|---|
| EP | 1 733 668 | 12/2006 |
| EP | 2 279 685 | 2/2011 |
| GB | 733977 | 7/1955 |
| WO | WO-2012/140452 | 10/2012 |

OTHER PUBLICATIONS

International Search Report and Written Opinion mailed Feb. 24, 2014, directed to International Application No. PCT/GB2014/050076; 9 pages.

Search Report dated Jun. 3, 2013, directed to GB Application No. 1301711.6; 1 page.

*Primary Examiner* — David Redding

(74) *Attorney, Agent, or Firm* — Morrison & Foerster LLP

(57) ABSTRACT

A dirt separator for a vacuum cleaner that comprises an inlet through which fluid enters the separator, and an outlet through which fluid exits the separator. The separator further comprises a filter assembly located downstream of the inlet and upstream of the outlet, an opening through which the filter assembly may be removed from the separator, and a hatch moveable between an open position in which the opening is uncovered and a closed position in which the opening is partially covered. When the filter assembly is removed from the separator and the hatch is in the closed position, a bleed is created around at least part of the hatch through which fluid enters the separator in preference to the inlet. When the filter assembly is located in the separator and the hatch is in the closed position, the filter assembly seals against the hatch to close the bleed.

11 Claims, 8 Drawing Sheets

DIRT SEPARATOR FOR A VACUUM CLEANER

REFERENCE TO RELATED APPLICATION

This application claims priority of United Kingdom Application No. 1301711.6 filed Jan. 31, 2013, the entire contents of which are incorporated herein by reference.

FIELD OF THE INVENTION

The present invention relates to a dirt separator for a vacuum cleaner.

BACKGROUND OF THE INVENTION

The dirt separator of a vacuum cleaner may comprise a filter for removing dirt from the fluid stream. The filter may be removable from the dirt separator in order that the filter may be washed. A problem, however, arises in that the vacuum cleaner may be used inadvertently without the filter. As a result, the suction source is exposed to a higher level of dirt, which may result in premature failure of the suction source.

SUMMARY OF THE INVENTION

The present invention provides a dirt separator for a vacuum cleaner comprising: an inlet through which fluid enters the dirt separator; an outlet through which fluid exits the dirt separator; a filter assembly located downstream of the inlet and upstream of the outlet; an opening through which the filter assembly may be removed from the dirt separator; and a hatch moveable between an open position in which the opening is uncovered and a closed position in which the opening is partially covered by the hatch, wherein (i) when the filter assembly is removed from the dirt separator and the hatch is in the closed position, a bleed is created around at least part of the hatch through which fluid enters the dirt separator in preference to the inlet, and (ii) when the filter assembly is located in the dirt separator and the hatch is in the closed position, the filter assembly seals against the hatch to close the bleed.

A bleed is therefore created whenever the filter assembly is removed from the dirt separator. The bleed is located downstream of the inlet. Consequently, should suction be applied at the outlet, relatively clean fluid is drawn into the dirt separator via the bleed. Little or no dirty fluid is drawn in through the inlet. As a result, the source responsible for generating the suction is better protected. The bleed is created around at least part of the hatch and thus provides a user with a visual indication that the filter assembly is missing. Additionally, the noise generated by the vacuum cleaner is likely to change as a result of fluid being drawn in through the bleed rather than the inlet. Consequently, the user is also presented with an audible indication that the filter assembly is missing.

The dirt separator has an access opening that is distinct from the outlet. As a result, the location, size and/or shape of the outlet may be configured independently of the filter assembly. In particular, the location, size and/or shape of the outlet may be configured in such a way that removal of the filter assembly via the outlet would prove difficult or impossible.

The filter assembly may comprise a filter medium supported on a frame, and part of the frame may extend beyond an end the filter medium, seal against the hatch to close the bleed, and comprise one or more apertures through which fluid passes. More specifically, the apertures may be located in a wall of the frame that extends in a direction away from the filter medium. The part of the frame that extends beyond the filter medium therefore serves two purposes. First, it acts to seal against the hatch and close the bleed. Second, it permits fluid to flow through the frame. As a result, fluid is free to flow into or out of the filter medium via the end proximate the access opening. This can lead to significant benefits in terms of the size and/or performance of dirt separator. For example, the access opening may be located at a top of the dirt separator, and the filter assembly may be located in a chamber having one or more ports through which fluid enters or exits the chamber. By having apertures in the frame, the ports may be located at the end of the chamber adjacent the access opening.

The filter medium may comprise a hollow interior and an open end, and the frame may extend beyond the open end of the filter medium. By employing a hollow filter medium, the surface area of the filter medium may be increased without unduly increasing the size of filter assembly. The apertures in the frame then allow the fluid to enter or exit the open end of the filter medium.

The path of fluid through the dirt separator may be such that fluid passes through the apertures in the frame before passing through the filter medium. Fluid is therefore able to enter the filter medium via an end proximate the access opening. Where the filter medium is hollow, the fluid acts to inflate the filter and thus prevent the filter from collapsing. As a result, it is not necessary for the frame to extend along the full length of the filter medium.

The filter assembly may be located in a chamber, and the chamber may comprise one or more ports through which fluid enters or exits the chamber. The frame may then seal against a wall of the chamber at positions above and below the ports, and the apertures in the frame may be located between the seals. The seals ensure that the fluid flowing through the chamber is prevented from bypassing the filter medium, thus ensuring the suction source is well protected.

The hatch may comprise a conical body that projects into the interior of the filter assembly when the hatch is in the closed position. This then has the advantage that the conical body is able to direct fluid along smoother path, thus reducing noise and fluid flow losses. Moreover, by projecting into the interior of the filter assembly, the conical body is able to redirect the fluid without increasing the overall size of dirt separator.

The dirt separator may comprise a cyclone stage located upstream of the filter assembly. The cyclone stage may then be used to remove coarse dirt and the filter assembly may be used to remove fine dirt. Since the filter assembly is then exposed to lower levels of dirt, the dirt separator may used be for longer periods before it becomes necessary to wash or replace the filter assembly.

The cyclone stage may comprise a plurality of cyclone bodies arranged around the filter assembly. By employing a plurality of cyclone bodies, the separation efficiency of the dirt separator may be improved. Moreover, by arranging the cyclone bodies around the filter assembly, a relatively compact dirt separator may be achieved.

The dirt separator may comprise a first cyclone stage, and the cyclone stage may be a second cyclone stage located downstream of the first cyclone stage. The first cyclone stage may then be used to remove larger dirt from the fluid and the second cyclone stage may be used to smaller dirt from the fluid. As a result, the separation efficiency of the dirt separator may be further improved. Additionally, since the filter assembly is exposed to yet lower levels of dirt, the dirt separator may used be for a longer period before having to wash or replace the filter assembly.

The dirt separator may comprise a handle for carrying the dirt separator, and the handle may be attached to the hatch. This then has the benefit that the handle may be used to open and/or close the hatch as well as carry the dirt separator.

The present invention further provides a vacuum cleaner comprising a main body and a dirt separator as described in any one of the preceding paragraphs, wherein the main body houses a suction source for applying suction at the outlet of the dirt separator, and the dirt separator is removably attached to the main body.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
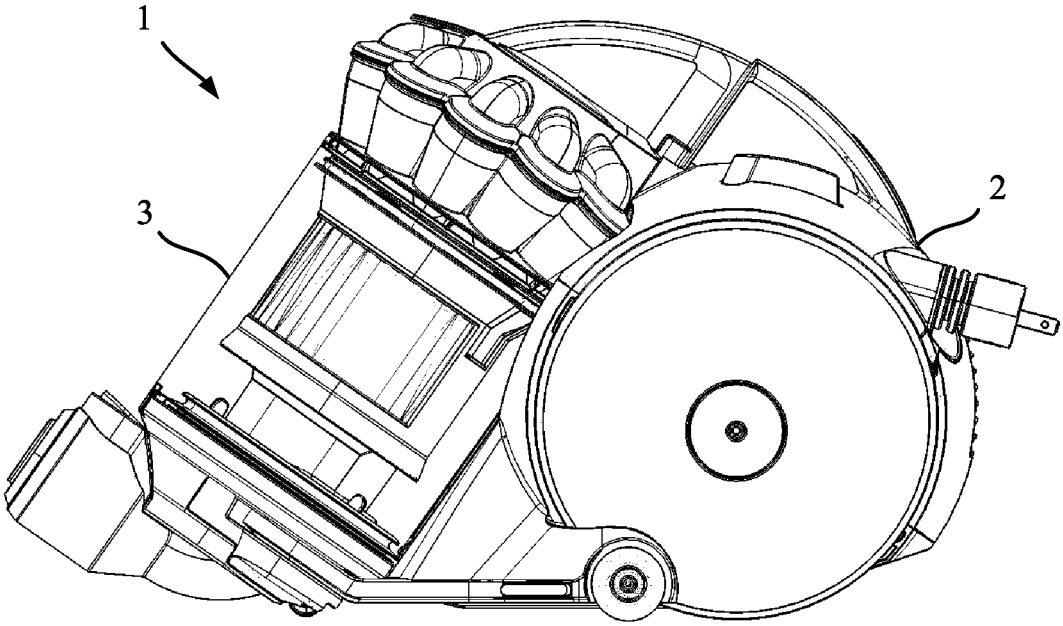
FIG. 1 is a side view of a vacuum cleaner in accordance with the present invention.
Figure 2:
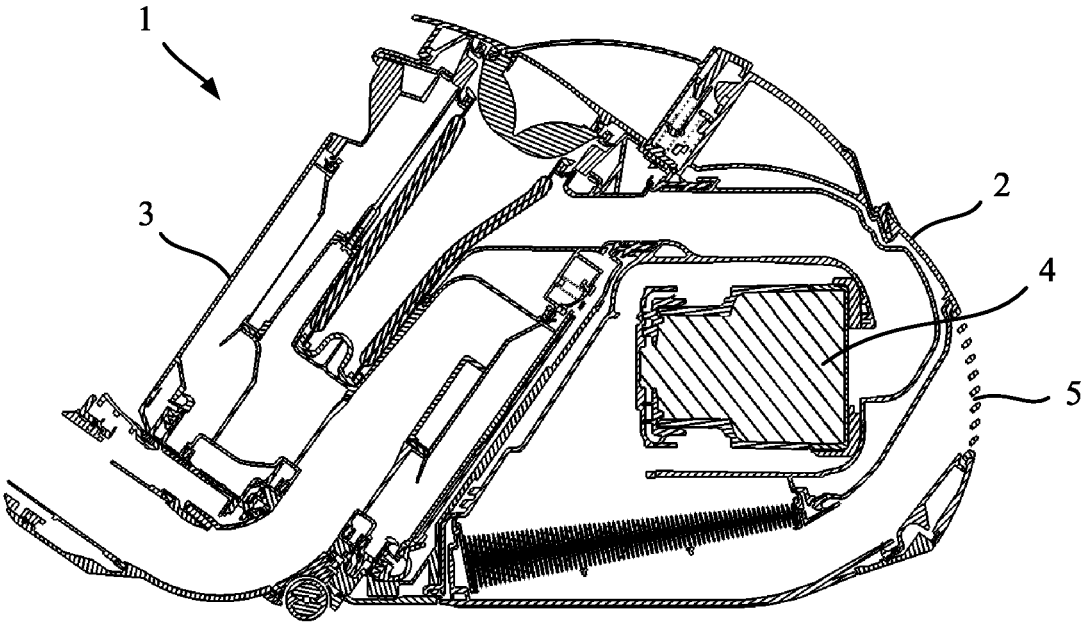
FIG. 2 is a sectional slice through the vacuum cleaner.
Figure 3:
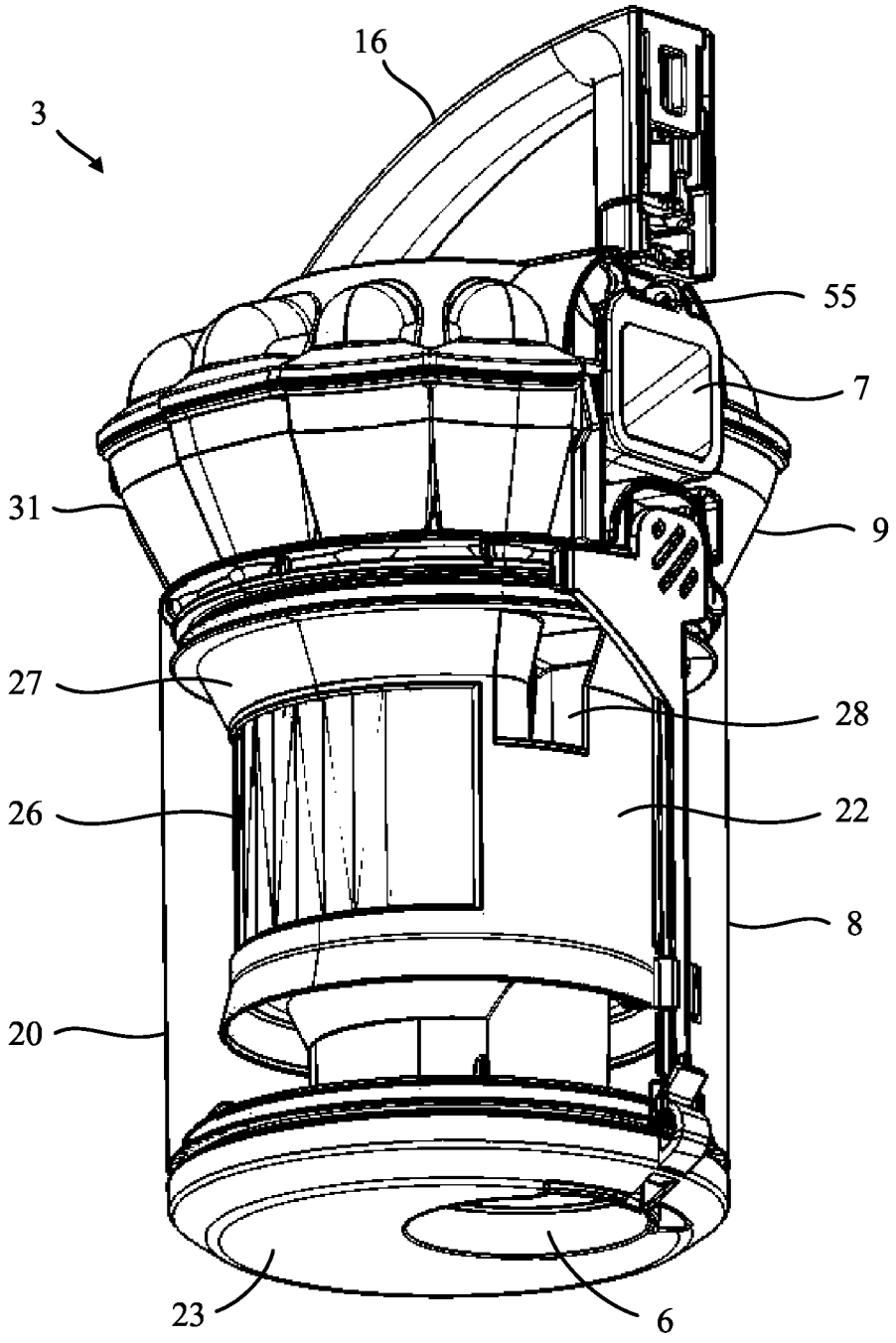
FIG. 3 is an orthographic view of the dirt separator of the vacuum cleaner.
Figure 4:
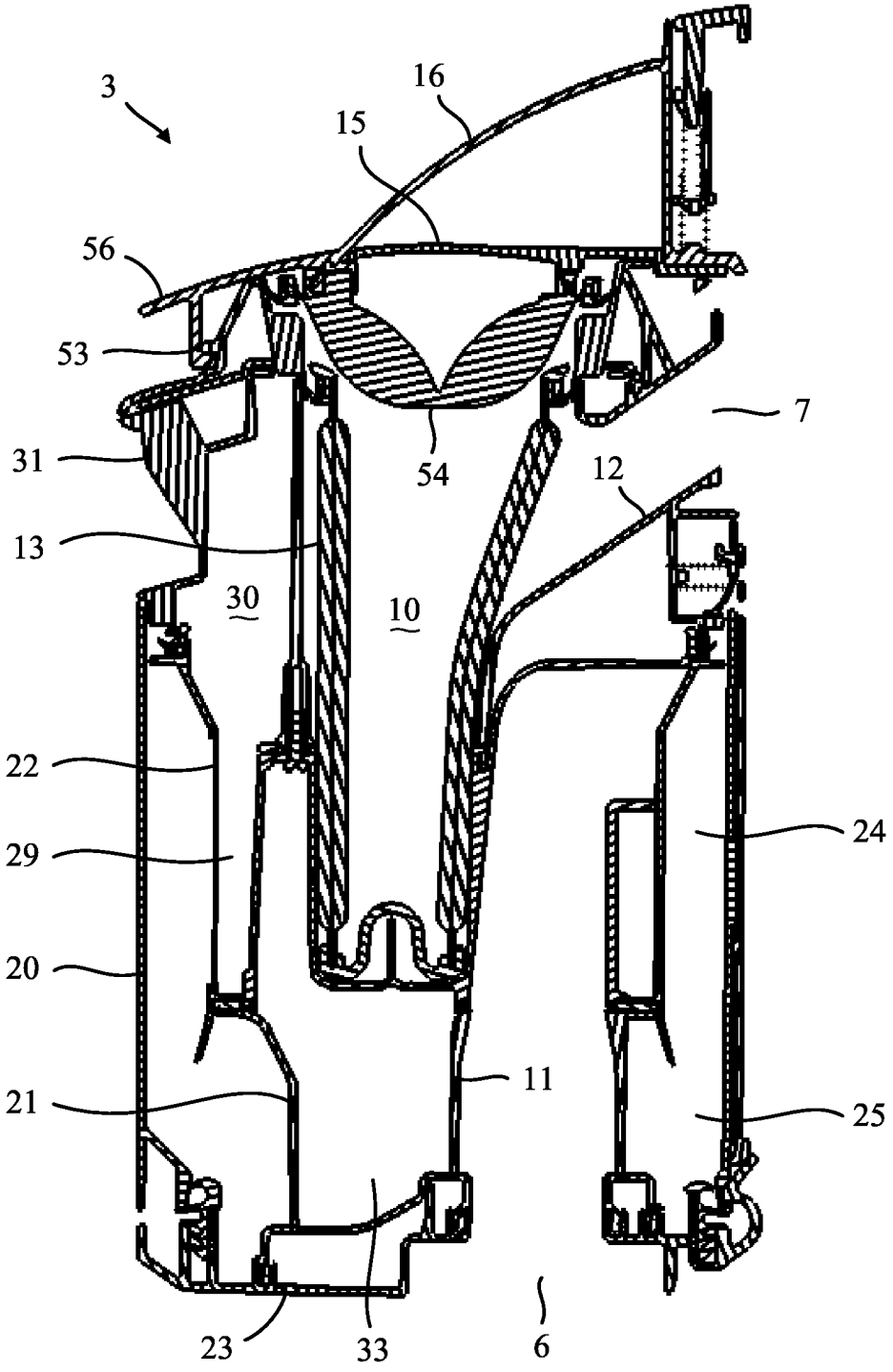
FIG. 4 is a sectional slice through the dirt separator.
Figure 5:
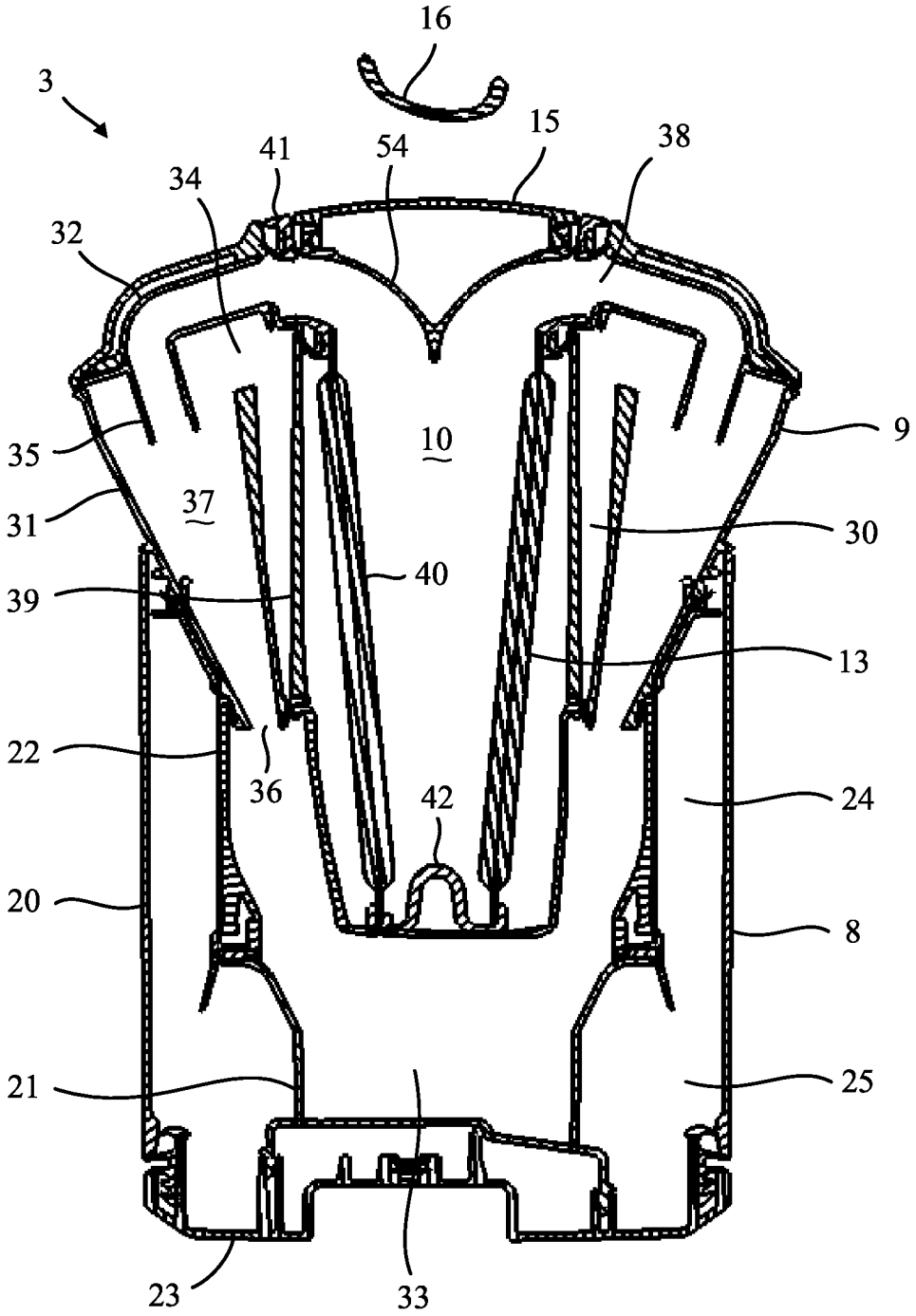
FIG. 5 is a further sectional slice through the dirt separator, the slice being taken in plane different to that of FIG. 4.
Figure 6:
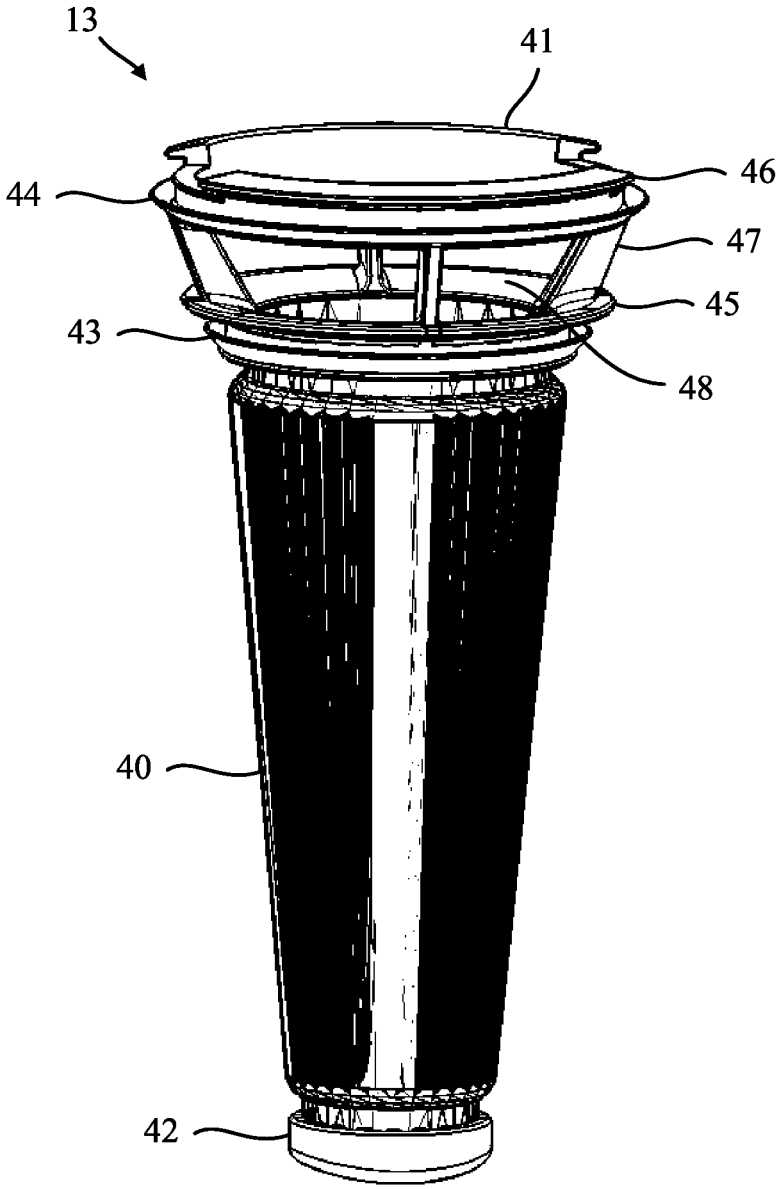
FIG. 6 is an orthographic view of the filter assembly of the dirt separator.
Figure 7:
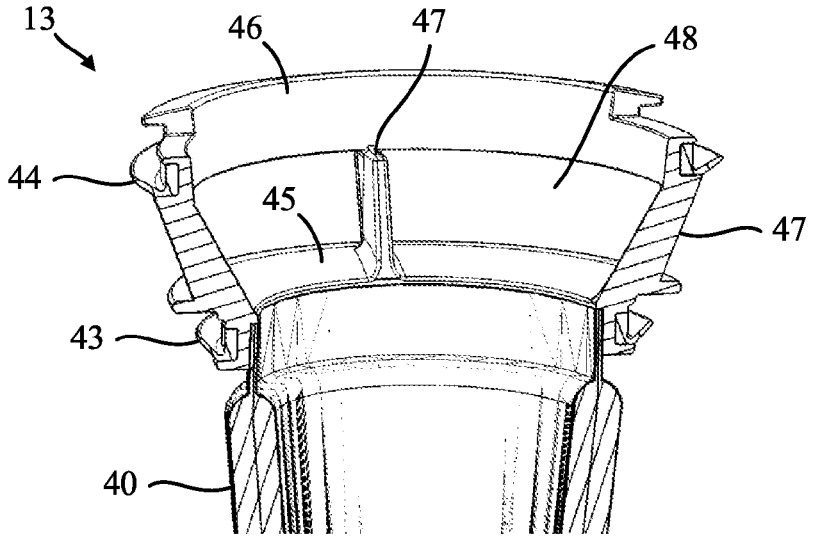
FIG. 7 is a sectional view through a top part of the filter assembly.
Figure 8:
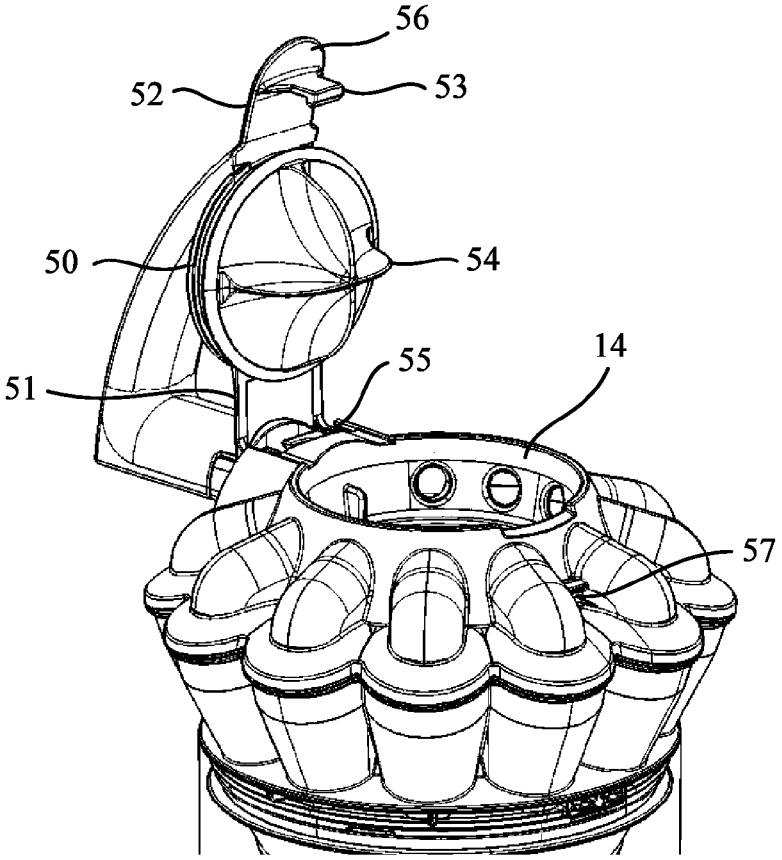
FIG. 8 is an orthographic view of the top part of the dirt separator in which the hatch of the dirt separator is in the open position and the filter assembly has been removed from the dirt separator.
Figure 9:
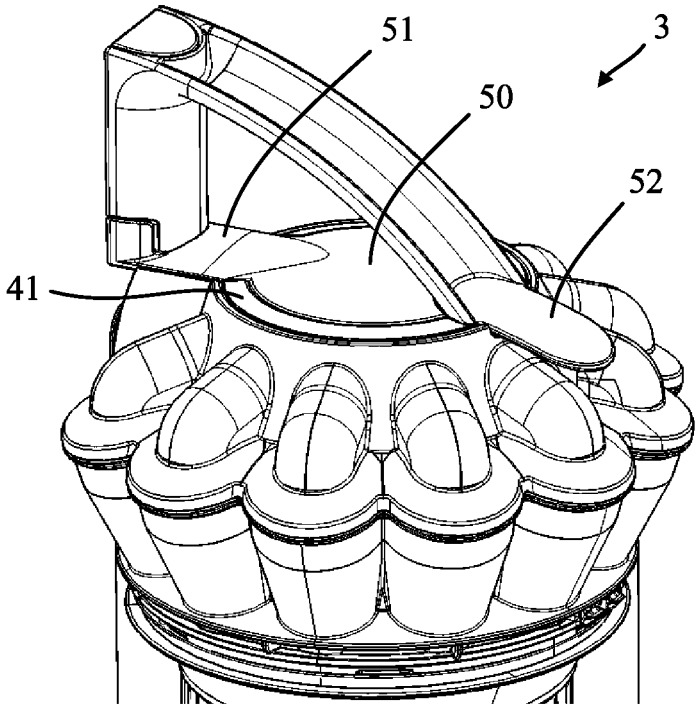
FIG. 9 is an orthographic view of the top part of the dirt separator in which the hatch is in the closed position and the filter assembly is located in the dirt separator.

The vacuum cleaner 1 of FIGS. 1 and 2 is of a canister type and comprises a main body 2 to which a dirt separator 3 is removably attached. The dirt separator 3 comprises an inlet 6 through which fluid enters the dirt separator 3, and an outlet 7 through which fluid exits the dirt separator 3. The main body 2 houses a suction source 4 which, during use, generates suction at the outlet 7, thereby causing fluid to be drawn in through the inlet 6. Dirt carried by the fluid is then separated by the dirt separator 3, and the cleansed fluid that exits the dirt separator 3 is drawn through the suction source 4 and exhausted via vents 5 in the main body 2.

Referring now to FIGS. 3 to 11, the dirt separator 3 comprises a first cyclone stage 8, a second cyclone stage 9 located downstream of the first cyclone stage 8, a filter chamber 10 located downstream of the second cyclone stage 9, an inlet duct 11 for carrying fluid from the inlet 6 to the first cyclone stage 8, an outlet duct 12 for carrying fluid from the filter chamber 10 to the outlet 7, a filter assembly 13 located in the filter chamber 10, an access opening 14 through which the filter assembly 13 may be removed from the dirt separator 3, a hatch 15 that partially covers the access opening 14, and a handle 16 for carrying the dirt separator 3.

The first cyclone stage 8 comprises an outer wall 20, an inner wall 21, and a shroud 22 located between the two walls 20,21. The upper end of the outer wall 20 is sealed against the shroud 22. The lower end of the outer wall 20 and the lower end of the inner wall 21 are sealed against and closed off by a base 23. The outer wall 20, the inner wall 21, the shroud 22 and the base 23 thus collectively define a chamber. The upper part of this chamber (i.e. that part generally defined between the outer wall 20 and the shroud 22) defines a cyclone chamber 24, whilst the lower part of the chamber (i.e. that part generally defined between the outer wall 20 and the inner wall 21) defines a dirt collection chamber 25. The shroud 22 comprises a mesh 26 supported on a frame 27. The frame 27 includes an aperture 28, through which fluid enters the cyclone chamber 24, whilst the mesh 26 comprises perforations through which fluid exits the cyclone chamber 24. The space between the shroud 22 and the inner wall 21 defines a fluid passageway 29, which is open at an upper end and provides an outlet for the first cyclone stage 8.

The second cyclone stage 9 comprises a plenum 30, a plurality of cyclone bodies 31, a plurality of guide ducts 32 and a dirt collection chamber 33. The plenum 30 is in fluid communication with the outlet of the first cyclone stage 8 (i.e. the fluid passageway 29) and with the inlets 34 of the cyclone bodies 31. Fluid from the first cyclone stage 8 therefore divides and feeds each of the cyclone bodies 31. The cyclone bodies 31 are arranged in a ring around the filter chamber 10. Each cyclone body 31 is generally frusto-conical in shape and comprises a tangential inlet 34, a vortex finder 35, and a cone opening 36. The interior of each cyclone body 31 defines a cyclone chamber 37. Fluid from the plenum 30 enters the cyclone chamber 37 via the tangential inlet 34. Dirt separated within the cyclone chamber 37 is then discharged through the cone opening 36 whilst the cleansed fluid exits through the vortex finder 35. Each guide duct 32 extends between a respective vortex finder 35 and the filter chamber 10. Consequently, fluid discharged from the cyclone bodies 31 is carried by the guide ducts 32 to the filter chamber 10. The dirt collection chamber 33 is defined by the interior space bounded by the inner wall 21 and the base 23. The cone opening 36 of each cyclone body 31 projects into the dirt collection chamber 33 such that dirt separated by the cyclone bodies 31 falls into the dirt collection chamber 33.

The filter chamber 10 is generally cylindrical in shape and extends centrally along the longitudinal axis of the dirt separator 3. The ends of the guide ducts 32 may be regarded as ports 38 through which fluid from the second cyclone stage 9 is discharged into the filter chamber 10. The ports 38 are then located around an upper end of a wall 39 of the filter chamber 10.

The inlet 5 of the dirt separator 3 is located in the base 23. The inlet duct 11 then extends upwardly from the inlet 5 and through the interior space bounded by the inner wall 21. At a height corresponding to an upper part of the first cyclone stage 8, the inlet duct 11 turns and extends through the inner wall 21, through the fluid passageway 29, and terminates at the aperture 28 in the shroud 22. The outlet 6 of the dirt separator 3 is located between two cyclone bodies 31 of the second cyclone stage 9. The outlet duct 12 then extends from the filter chamber 10 to the outlet 6.

The filter assembly 13 is elongate in shape and comprises a filter medium 40, a frame 41, an end cap 42, a first seal 43 and a second seal 44. The filter medium 40 is shaped as a hollow tube that is held open at an upper end by the frame 41, and is closed off at a lower end by the end cap 42. The frame 41 comprises a first ring 45, a second ring 46, and a plurality of braces 47 that extend between the two rings 45,46. The two rings 45,46 are arranged concentrically, with the second ring 46 having a slightly larger diameter. The first ring 45 is secured to and holds open the upper end of the filter medium 40. The braces 47 and the second ring 46 then extend beyond the upper end of the filter medium 40. The rings 45,46 and the braces 47 collectively delimit a plurality of apertures 48 in the frame 41. The first seal 43 is provided around the outside of the first ring 45 and the second seal 46 is provided around the outside of the second ring 46.

When the filter assembly 13 is located in the filter chamber 10, the first seal 43 seals against the wall 39 of the filter chamber 10 at a position below the ports 38, and the second seal 44 seals against the wall 39 at a position above the ports 38. The apertures 48 in the frame 41 are located between the two seals 43,44 such that fluid entering the filter chamber 10 via the ports 38 passes through the apertures 48 in the frame 41 and into the interior of the filter medium 40. The first seal 43 ensures that no fluid is drawn into the filter chamber 10 via the access opening 14. The second seal 44 ensures that fluid entering the filter chamber 10 via the ports 38 does not bypass the filter medium 40 and pass directly to the outlet duct 12.

The access opening 14 is located at a top of the dirt separator 3. More specifically, the access opening 14 is located at the top of the filter chamber 10. The access opening 14 is circular in shape and is sized such that the filter assembly 13 may be removed from the dirt separator 3 via the access opening 14.

The hatch 15 is moveable between an open position and a closed position. When in the closed position, the hatch 15 partially covers the access opening 14. Conversely, when the hatch 15 is in the open position, the access opening 14 is uncovered and thus the filter assembly 13 may be removed from the dirt separator 3. The hatch 15 comprises a central disc 50, a first arm 51 and a second arm 52 that extend radially outward from opposite sides of the disc 50, a locking projection 53 provided on the second arm 52, and a silencer 54 attached to the underside of the central disc 50. The end of the first arm 51 is attached to an upper part of the second cyclone stage 9 by means of a hinge 55. The hatch 15 is therefore movable between the open and closed positions by pivoting the hatch 15 about the hinge 55. When in the hatch 15 is in the closed position, the locking projection 53 engages with a recess 57 in the outer surface of the second cyclone stage 9 to lock the hatch 15. The free end of the second arm defines a tab 56, which a user may pull upwards in order to disengage the locking projection 53 from the recess 57 and thus unlock the hatch 15. The silencer 54 is formed of an elastic material, such as rubber, and comprises a conical body, a seal, and a plurality of baffles. The conical body is hollow and has a concave outer surface. The seal is located around the base of the conical body, and the baffles, which are generally planar in shape, extend outwardly from the conical body.

When the hatch 15 is in the closed position and the filter assembly 13 is located in the dirt separator 3, the hatch 15 seals against the filter assembly 13. More specifically, the seal of the silencer 54 engages with and seals against the inner surface of the second ring 46 of the frame 41. The conical body and the baffles then project into the interior of the filter assembly 13. As fluid passes through the apertures 48 in the frame 41, the conical body redirects the fluid downwards. Owing to the curved, conical surface of the body, the fluid is redirected along a relatively smooth path, resulting in acoustic as well as fluid flow benefits. The baffles act to reduce clashing of the fluid entering the filter chamber via different ports. In particular, fluid entering via one port is prevented from clashing directly with fluid entering via an opposing port. As a result, further acoustic and fluid flow benefits are achieved.

Figure 10:
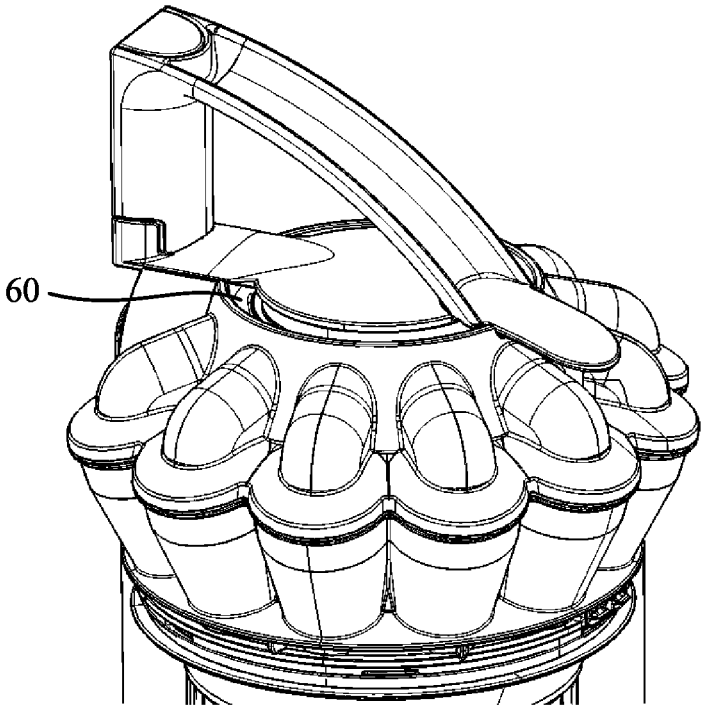
FIG. 10 is an orthographic view of the top part of the dirt separator in which the hatch is in the closed position and the filter assembly has been removed from the dirt separator.
Figure 11:
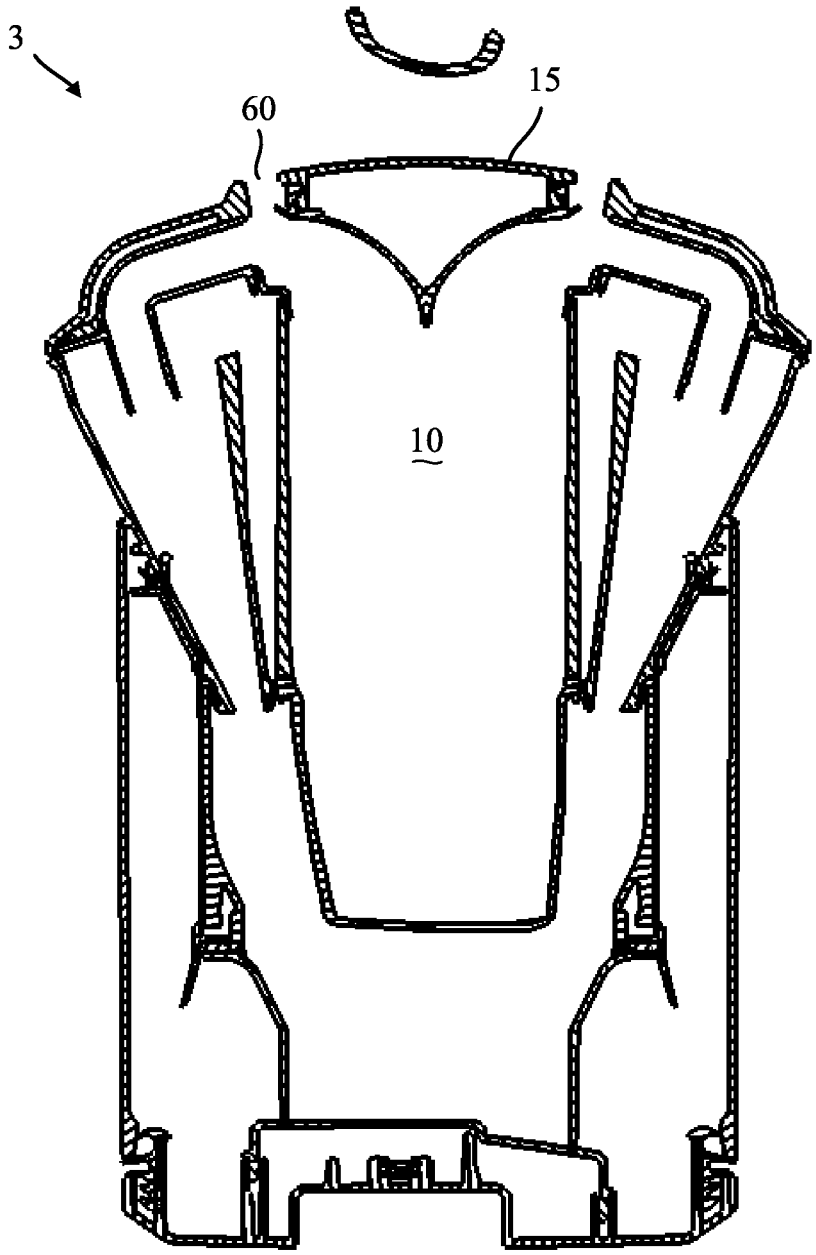
FIG. 11 is the same sectional slice as that of FIG. 5 but with the filter assembly removed from dirt separator.

When the hatch 15 is in the closed position and the filter assembly 13 is removed from the dirt separator 3, a bleed 60 is created around part of the hatch 15 (see FIGS. 10 and 11). The bleed 60 takes the form of a gap between the disc 50 and the wall 39 of the filter chamber 10. The bleed 60 arises because the hatch 15 covers the access opening 14 only partially when in the closed position. That part of the access opening 14 which is not covered by the hatch 15 thus defines the bleed 60. As explained below in more detail, should the vacuum cleaner 1 be powered on when the filter assembly 13 is removed from the dirt separator 3, air is drawn into the bleed 60 in preference to the inlet 5 of the dirt separator 3.

The handle 16 is attached to the hatch 15. More specifically, one end of the handle 16 is attached to the first arm 51 of the hatch 15 and the other end of the handle 16 is attached at the join between the disc 50 and second arm 52. The handle 16 therefore pivots along with the hatch 15 when moved between the open and closed positions. When the hatch 15 is in the open position, the handle 16 may be used to close and lock the hatch 15. When the hatch 15 is in the closed position, pulling the handle 16 upwards causes the hatch 15 to flex upwards at the join between the disc 50 and second arm 52. Since the locking projection 53 is located further along the second arm 52, pulling the handle 16 upwards generates a moment of force that encourages the locking projection 53 to project further into the recess 57. It is not therefore possible (or it is certainly very difficult) to open the hatch 15 by pulling the handle 16 upwards. This then has the advantage that the handle 16 may be used to carry the dirt separator 3 and the vacuum cleaner 1 without fear of the hatch 15 inadvertently opening. That being said, the handle 14 may be configured such that the handle 14 can be used to both open and close the hatch 15. For example, rather than attaching at the join between the disc 50 and the second arm 52, the handle 16 may attach at the free end of the second arm 52. Pulling the handle 16 upwards with sufficient force would then cause the locking projection 53 to disengage from the recess 57.

The operation and maintenance of the vacuum cleaner 1 will now be described.

When the vacuum cleaner 1 is powered on, the suction source 4 generates suction at the outlet 6 of the dirt separator 3, thus causing dirt-laden fluid to be drawn in through the inlet 5. From there, the fluid is carried by the inlet duct 11 to the aperture 28 in the shroud 22. The fluid then enters the cyclone chamber 24 of the first cyclone stage 8. The dirt-laden fluid spirals about the cyclone chamber 24 causing coarse dirt to be separated from the fluid. The coarse dirt collects in the dirt collection chamber 25 of the first cyclone stage 8, whilst the partially-cleansed fluid is drawn through the mesh 26 of the shroud 22, up through the fluid passageway 29, and into the plenum 30 of the second cyclone stage 9. The partially-cleansed fluid then divides and is drawn into the cyclone bodies 31 via the tangential inlets 34. The fluid then spirals about the cyclone chamber 37 of each cyclone body 31 causing fine dirt to be separated from the fluid. The fine dirt is discharged through the cone opening 36 and into the dirt collection chamber 33 of the second cyclone stage 9. The cleansed fluid is drawn up through the vortex finders 35 and along the guide ducts 32 to the filter chamber 10. From there, the cleansed fluid passes through the apertures 48 in the frame 41 of the filter assembly 9, and is directed downwards and into the interior of the filter medium 40 by the silencer 54. The fluid passes through the filter medium 40, which acts to remove any residual dirt from the fluid. The fluid is then drawn along the outlet duct 12 and through the outlet 6 of the dirt separator 3. From there, the cleansed fluid is drawn through the suction source 4 and is exhausted via vents 5 in the main body 2.

Dirt collected by the dirt separator 3 may be emptied by removing the dirt separator 3 from the main body 2, carrying the dirt separator 3 to a bin or the like, and emptying the contents of the two dirt collection chambers 25,33 (e.g. by pivoting the base 23 downwards relative to the outer wall 20).

After prolonged use, the filter medium 40 may become clogged and thus adversely affect the performance of the vacuum cleaner 1. The filter assembly 13 is intended to be removable from the dirt separator 3 in order that the filter assembly 13 may be washed or replaced. The filter assembly 13 is removed by first opening the hatch 15. The hatch 15 is opened by grabbing the tab 56 at the end of the second arm 52 and pulling upwards. This causes the locking projection 53 to disengage from the recess 57. Thereafter, the disc 50 pivots upwards and backwards such that the access opening 14 is uncovered. The filter assembly 13 may then be removed from the dirt separator 3 via the access opening 14.

It is possible to close the hatch 15 without first returning the filter assembly 13 to the dirt separator 3. Should this occur, the bleed 60 is exposed around part of the hatch 15. The bleed 60 is clearly visible around the hatch 15 and thus provides the user with a visual indication that the filter assembly 13 is missing. In spite of the visual indicator, a user may nevertheless return the dirt separator 3 to the main body 2. Should the vacuum cleaner 1 then be powered on, fluid is drawn into the dirt separator 3 through the bleed 60 in preference to the inlet 5. In contrast to the dirt-laden fluid that is drawn in through the inlet 5, the fluid drawn in through the bleed 60 is relatively clean. As a result, the suction source 4 is better protected. In addition to providing a visual indicator that the filter assembly 13 is missing, the bleed 60 may also provide an audible indicator. In particular, fluid drawn in through the bleed 60 is likely to make a different noise to that generated when fluid is drawn in through the inlet 5.

The access opening 14 of the dirt separator 3 is quite distinct from the outlet 6. The dirt separator 3 is therefore different to known dirt separators having a filter assembly that is removable via the outlet. As a result of having a distinct access opening 14, the location, size and/or shape of the outlet 6 may be configured without consideration of the filter assembly 13. In particular, the location, size and/or shape of the outlet 6 may be configured in such a way that removal of the filter assembly 13 via the outlet 6 would prove difficult or impossible. Indeed, in the embodiment illustrated in the Figures, the size of the outlet 6 is significantly smaller than that of the filter assembly 13.

The part of the frame 41 that extends beyond the filter medium 40 serves two useful functions. First, it acts to seal against the hatch 15 and close the bleed 60. Second, the apertures 48 in the frame 41 permit fluid to flow through the frame 41 and into the filter medium 40. This then enables the open end of the filter medium 40 to be located proximate the access opening 14. This then has benefits in terms of the size and performance of dirt separator 13. For example, the second cyclone stage 9 comprises a plurality of cyclone bodies 31 that surround the filter chamber 10 and which discharge fluid in a generally upwards direction. In having the cyclone bodies 31 that surround the filter chamber 10, a relatively compact arrangement is achieved. Since fluid is discharged from the cyclone bodies 31 in a generally upward direction, the ports 38 are ideally located at an upper part of the filter chamber 10. By having a frame 41 that both closes the bleed 60 and enables fluid to flow through the frame 41, the open end of the filter medium 40 may also be located at the upper part of the filter chamber 10. As a result, a relatively short path with few bends is taken by the fluid as it flows from the cyclone bodies 31 to the filter medium 40, which helps reduce fluid flow losses.

The filter medium 40 is shaped as a hollow tube, which has the advantage that the surface area (and thus the efficacy) of the filter medium 40 may be increased without unduly increasing the size of the filter assembly 13. Owing to the apertures 48 in the frame 41, fluid is able to flow into the interior of the filter medium 40 via the open end. The fluid then acts to inflate the filter medium 40 and thus prevent the filter medium 40 from collapsing. As a result, it is not necessary for the frame 41 to extend along the full length of the filter medium 40.

Although a particular embodiment of dirt separator has thus far been described, various modifications may be made to the dirt separator without departing from the scope of the invention as defined by the claims. By way of example only, the dirt separator described above has two cyclone stages that remove dirt from the fluid prior to the filter assembly. This then has the benefit that the filter assembly is exposed to lower levels of dirt, and thus the dirt separator may used be for longer periods before it becomes necessary to wash or replace the filter assembly. Nevertheless, the cyclone stages could conceivably be omitted from the dirt separator and the filter assembly may provide the sole means for removing dirt from the fluid.

Although the vacuum cleaner of FIGS. 1 and 2 is of a canister type, the dirt separator may equally be employed with other types of vacuum cleaner, e.g. upright, handheld, stick or autonomous cleaner.

The invention claimed is:

1. A dirt separator for a vacuum cleaner comprising:

an inlet through which fluid enters the dirt separator;

an outlet through which fluid exits the dirt separator;

a filter assembly located downstream of the inlet and upstream of the outlet;

an opening through which the filter assembly can be removed from the dirt separator; and a hatch moveable between an open position in which the opening is uncovered and a closed position in which the opening is partially covered by the hatch, wherein (i) when the filter assembly is removed from the dirt separator and the hatch is in the closed position, a bleed is created around at least part of the hatch through which fluid enters the dirt separator in preference to the inlet, and (ii) when the filter assembly is located in the dirt separator and the hatch is in the closed position, the filter assembly seals against the hatch to close the bleed.

2. The dirt separator of claim 1, wherein the filter assembly comprises a filter medium supported on a frame, and part of the frame extends beyond an end of the filter medium, seals against the hatch to close the bleed, and comprises one or more apertures through which fluid passes.

3. The dirt separator of claim 2, wherein the filter medium comprises a hollow interior and an open end, and the part of the frame extends beyond the open end of the filter medium.

4. The dirt separator of claim 2, wherein fluid passes through the apertures in the frame before passing through the filter medium.

5. The dirt separator of claim 2, wherein the filter assembly is located in a chamber, the chamber comprises one or more ports through which fluid enters or exits the chamber, the frame seals against a wall of the chamber at positions above and below the ports, and the apertures in the frame are located between the seals.

6. The dirt separator of claim 1, wherein the hatch comprises a conical body that projects into the interior of the filter assembly when the hatch is in the closed position.

7. The dirt separator of claim 1, wherein the dirt separator comprises a cyclone stage located upstream of the filter assembly.

8. The dirt separator of claim 7, wherein the cyclone stage comprises a plurality of cyclone bodies arranged around the filter assembly.

9. The dirt separator of claim 8, wherein the dirt separator comprises a first cyclone stage, and the cyclone stage is a second cyclone stage located downstream of the first cyclone stage.

10. The dirt separator of claim 1, wherein the dirt separator comprises a handle for carrying the dirt separator, and the handle is attached to the hatch.

11. A vacuum cleaner comprising a main body and the dirt separator of claim 1, wherein the main body houses a suction source for applying suction at the outlet of the dirt separator, and the dirt separator is removably attached to the main body.

* * * * *